US007354495B2

(12) United States Patent
Carter et al.

(10) Patent No.: US 7,354,495 B2
(45) Date of Patent: Apr. 8, 2008

(54) METHOD OF MAKING A WATER TREATMENT COMPOSITE PRESSURE VESSEL

(75) Inventors: Thomas G. Carter, Kent, OH (US); Robert J. Pristas, Chardon, OH (US)

(73) Assignee: Enpress, L.L.C., Eastlake, OH (US)

( * ) Notice: Subject to any disclaimer, the term of this patent is extended or adjusted under 35 U.S.C. 154(b) by 305 days.

(21) Appl. No.: 11/273,407

(22) Filed: Nov. 14, 2005

(65) Prior Publication Data

US 2006/0060289 A1 Mar. 23, 2006

Related U.S. Application Data

(63) Continuation of application No. 10/268,823, filed on Oct. 10, 2002, now abandoned.

(60) Provisional application No. 60/329,134, filed on Oct. 12, 2001.

(51) Int. Cl.
*B65H 81/00* (2006.01)

(52) U.S. Cl. ..... 156/172; 156/169; 156/192

(58) Field of Classification Search ..... 156/169, 156/172, 173, 175, 192, 191, 189, 194
See application file for complete search history.

(56) References Cited

U.S. PATENT DOCUMENTS

| | | | | |
|---|---|---|---|---|
| 3,091,000 | A | | 5/1963 | Makowski |
| 3,137,898 | A | | 6/1964 | Geringer |
| 3,177,105 | A | | 4/1965 | Wiltshire |
| 3,426,940 | A | | 2/1969 | Broerman |
| 3,508,677 | A | * | 4/1970 | Laibson et al. ..... 220/590 |
| 3,649,409 | A | | 3/1972 | Bell et al. |
| 3,816,578 | A | | 6/1974 | Fuller |

(Continued)

FOREIGN PATENT DOCUMENTS

| | | |
|---|---|---|
| DE | 234776 | 5/1911 |

(Continued)

OTHER PUBLICATIONS

WO 01/64427 A1, Method for Fabricating Composite Pressure Vessels and Products Fabricated by the Method, Publication Date: Sep. 7, 2001.

(Continued)

*Primary Examiner*—Jeff H. Aftergut
(74) *Attorney, Agent, or Firm*—Rankin, Hill & Clark LLP

(57) ABSTRACT

A composite pressure vessel includes an endcap with first and second layers. The first layer is a thermoplastic layer and the second layer is a thermoplastic and glass fiber composite layer. A method for making the vessel includes placing commingled thermoplastic and glass fibers in a heated mold to melt the thermoplastic. The molten thermoplastic and the glass fibers are molded into the endcap shape. An outer surface of the pressure vessel is finished in accordance with another aspect of the invention. A pressurizable bladder with an inwardly facing surface is deflated. The outer surface of the vessel is heated to soften the thermoplastic. The pressure vessel is positioned in the bladder so that the inwardly facing surface of the bladder is adjacent to an outer surface of the pressure vessel. The bladder is pressurized to move the bladder inwardly into contact with the adjacent surfaces to each other.

11 Claims, 7 Drawing Sheets

U.S. PATENT DOCUMENTS

| | | | |
|---|---|---|---|
| 3,937,781 | A | 2/1976 | Allen |
| 3,962,393 | A | 6/1976 | Blad |
| 3,970,495 | A | 7/1976 | Ashton et al. |
| 4,126,659 | A | 11/1978 | Blad |
| 4,169,749 | A | 10/1979 | Clark |
| 4,256,231 | A | 3/1981 | Cioc et al. |
| 4,267,142 | A | 5/1981 | Lankheet |
| 4,327,052 | A | 4/1982 | Sauer |
| 4,537,329 | A | 8/1985 | Norton |
| 4,576,776 | A | 3/1986 | Anderson |
| 4,584,041 | A | 4/1986 | Lyman et al. |
| 4,588,106 | A | 5/1986 | Stark et al. |
| 4,589,563 | A | 5/1986 | Born |
| 4,619,374 | A | 10/1986 | Yavorsky |
| 4,657,717 | A | 4/1987 | Cattanach et al. |
| 4,740,262 | A | 4/1988 | Yavorsky et al. |
| 4,876,050 | A | 10/1989 | Horton |
| 4,940,563 | A | 7/1990 | Kromrey |
| 4,961,977 | A | 10/1990 | Archer et al. |
| 4,982,856 | A | 1/1991 | Stokes |
| 5,009,941 | A | 4/1991 | Pollet et al. |
| 5,012,950 | A | 5/1991 | Knappe |
| 5,025,943 | A | 6/1991 | Forsman |
| 5,049,349 | A | 9/1991 | McCullough et al. |
| 5,085,821 | A | 2/1992 | Nohara |
| 5,137,071 | A | 8/1992 | Ashton et al. |
| 5,150,812 | A | 9/1992 | Adams |
| 5,202,165 | A | 4/1993 | Lusignea et al. |
| 5,208,051 | A | 5/1993 | Berg et al. |
| 5,227,236 | A | 7/1993 | Handermann |
| 5,242,517 | A | 9/1993 | Endoh |
| H1261 | H | 12/1993 | Gibson et al. |
| 5,287,987 | A | 2/1994 | Gaiser |
| 5,342,463 | A | 8/1994 | Addeo et al. |
| 5,345,666 | A | 9/1994 | Matyja |
| 5,358,683 | A | 10/1994 | Rhodes |
| 5,368,073 | A | 11/1994 | Murphy |
| 5,385,262 | A | 1/1995 | Coquet et al. |
| 5,429,845 | A | 7/1995 | Newhouse et al. |
| 5,499,739 | A | 3/1996 | Greist, III et al. |
| 5,501,012 | A | 3/1996 | Nogles |
| 5,518,141 | A | 5/1996 | Newhouse et al. |
| 5,556,601 | A | 9/1996 | Huvey et al. |
| 5,571,357 | A | 11/1996 | Darrieux et al. |
| 5,575,875 | A | 11/1996 | Brittingham et al. |
| 5,672,309 | A | 9/1997 | Masui et al. |
| 5,763,027 | A | 6/1998 | Enders et al. |
| 5,816,436 | A | 10/1998 | Grosjean et al. |
| 5,817,203 | A | 10/1998 | Moser |
| 5,862,938 | A | 1/1999 | Brukett |
| 5,900,107 | A | 5/1999 | Murphy et al. |
| 5,954,222 | A | 9/1999 | White et al. |
| 6,171,423 | B1 | 1/2001 | Murphy et al. |
| 6,190,598 | B1 | 2/2001 | Murphy et al. |
| 6,228,312 | B1 | 5/2001 | Boyce |
| 6,298,553 | B1 | 10/2001 | Hlebovy |
| 6,325,959 | B1 | 12/2001 | Ek et al. |
| 6,387,524 | B1 | 5/2002 | Finefrock |
| 6,485,668 | B1 | 11/2002 | Murphy et al. |
| 2002/0117781 | A1 | 8/2002 | LeBreton |

FOREIGN PATENT DOCUMENTS

| | | |
|---|---|---|
| DE | 42 15 756 A1 | 11/1993 |
| EP | 0 635 672 B1 | 7/1993 |
| GB | 859554 | 1/1961 |
| JP | 53-34870 | 3/1978 |
| JP | 59-5035 | 1/1984 |

OTHER PUBLICATIONS

WO 98/51480, Arrangement, Method and Hollow Body in Connection With Forming of Plastic Components, Publication Date: Nov. 19, 1998.

* cited by examiner

METHOD OF MAKING A WATER TREATMENT COMPOSITE PRESSURE VESSEL

CROSS REFERENCE TO RELATED APPLICATIONS

This application is a continuation of U.S. patent application Ser. No. 10/262,823, now abandoned filed Oct. 10, 2002, which claims priority to U.S. Provisional Application Ser. No. 60/329,134 filed Oct. 12, 2001.

BACKGROUND OF THE INVENTION

1. Field of the Invention

The present invention relates generally to thermoplastic vessels and, more specifically, to composite thermoplastic pressure vessels and methods for making same.

2. Discussion of Related Art

Water tanks for use in commercial and household applications are typically made from steel or thermoset plastic. Steel tanks are generally considered to be more durable than their plastic counterparts, but are heavier and subject to corrosion.

While the use of thermoset plastic has addressed the problem of corrosion associated with steel tanks, fabrication and manufacture of suitable thermoset plastic tanks has proven to be problematic. Factors including lengthy process times, wasted raw materials, environmental concerns, and undesirable physical properties of the finished tank have traditionally been associated with the manufacture of thermoset plastic tanks.

SUMMARY OF THE INVENTION

In accordance with the present invention, a composite vessel includes first and second endcaps and a liner. Each endcap includes a first layer and a second layer. The first layer is a thermoplastic layer and the second layer is a thermoplastic and glass fiber composite layer.

In further accordance with the present invention, an injection-molded endcap has a dome-shaped body with a circular free end. An insert is integrally molded with the endcap body, and has a threaded inner surface and a radially projecting flange. The flange is surrounded or encapsulated in the endcap body.

The present invention also provides a method for making a pressure vessel. The method includes placing commingled thermoplastic and glass fibers in a mold, heating the mold to a temperature sufficient to melt the thermoplastic such that it flows around and encapsulates the commingled glass fibers, and molding the molten thermoplastic and the glass fibers into an endcap.

The present invention also provides a method and system for texturing an outer surface of a thermoplastic pressure vessel. The texturing system includes a pressurizable bladder that is selectively movable between an inflated and a deflated condition. The inner surface of the bladder that will engage the pressure vessel and has a desired texture formed thereon. In accordance with the texturing method, the outer vessel surface is heated to soften the thermoplastic, and then the pressure vessel is inserted into the bladder so that the textured surface of the bladder is adjacent the outer surface of the pressure vessel. The bladder is pressurized to move the bladder into engagement with the vessel outer surface to conform the outer surface of the vessel to the surface texture of the bladder.

BRIEF DESCRIPTION OF THE DRAWINGS

These and further features of the invention will be apparent with reference to the following description and drawings, wherein.

DETAILED DESCRIPTION OF PREFERRED EMBODIMENTS

Figure 1:
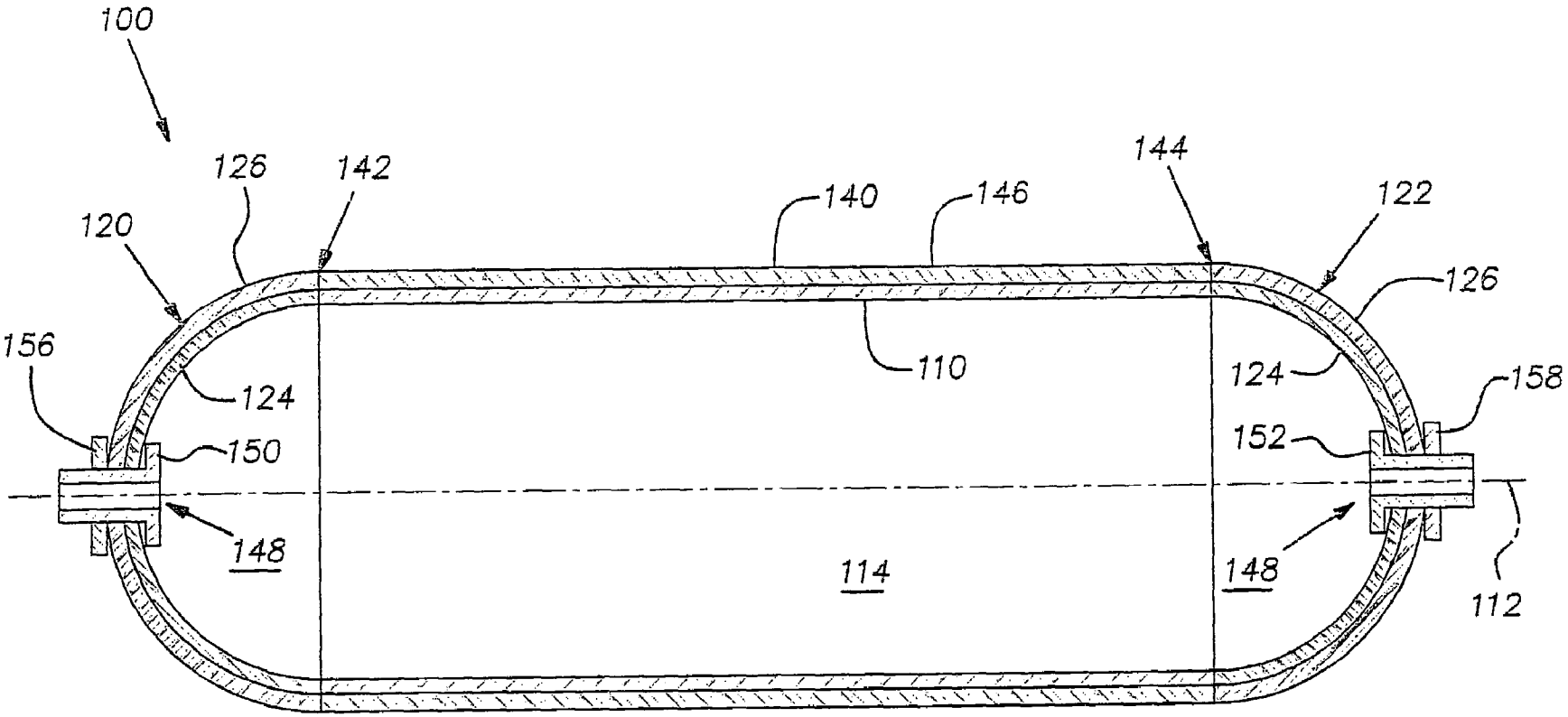
FIG. 1 is a cross-sectional side view of a composite pressure vessel according to a first embodiment of the invention.

A composite pressure vessel 100 according to a first embodiment of the present invention is shown in FIG. 1. The vessel 100 is a composite shell for use in, for example, a residential water system, a water storage tank, and a water treatment system.

The vessel 100 includes a non-fiber reinforced thermoplastic, polypropylene liner 110 that defines an axis 112. The liner 110 may be extruded, injection molded, or formed by other means.

The vessel 100 also includes first and second dome-shaped, semi-hemispherical endcaps 120, 122. The endcaps 120, 122 are generally identical and include a first, inner layer 124 and a second, outer layer 126. The first layer 124 is a thermoplastic polypropylene liner layer, while the second layer 126 is a reinforced thermoplastic, as will be described more fully hereinafter. In alternative embodiments, suitable endcaps are frusto-conical or flattened, and the endcaps need not be alike. Moreover, the endcaps may be of any desired shape or size.

The endcaps 120, 122 are secured to first and second ends of the liner 110 at respective first and second transition areas 142, 144. The liner 110 and the endcaps 120, 122 cooperate to define a cavity 114. The endcaps 120, 122 are secured to the liner 110 at the transition areas 142, 144 by laser welding, hotplate welding, spin welding, or equivalent techniques known in the art of thermoplastic material joining or fabrication. In a preferred embodiment, the endcaps 120, 122 are laser welded to the liner 110.

The second layer 126 is a thermoplastic and oriented glass fiber composite layer. Preferably, the second layer 126 is formed from a commingled thermoplastic and glass fiber fabric sold as TWINTEX, commercially available from Saint-Gobain Vetrotex America Inc. (Valley Forge, Pa.), hereinafter referred to as commingled fabric. In this embodiment, the glass fibers are woven and in the form of a fabric mat, and in alternative embodiments, the oriented fibers are biaxial, triaxial, looped, and/or stitched.

Figure 2:
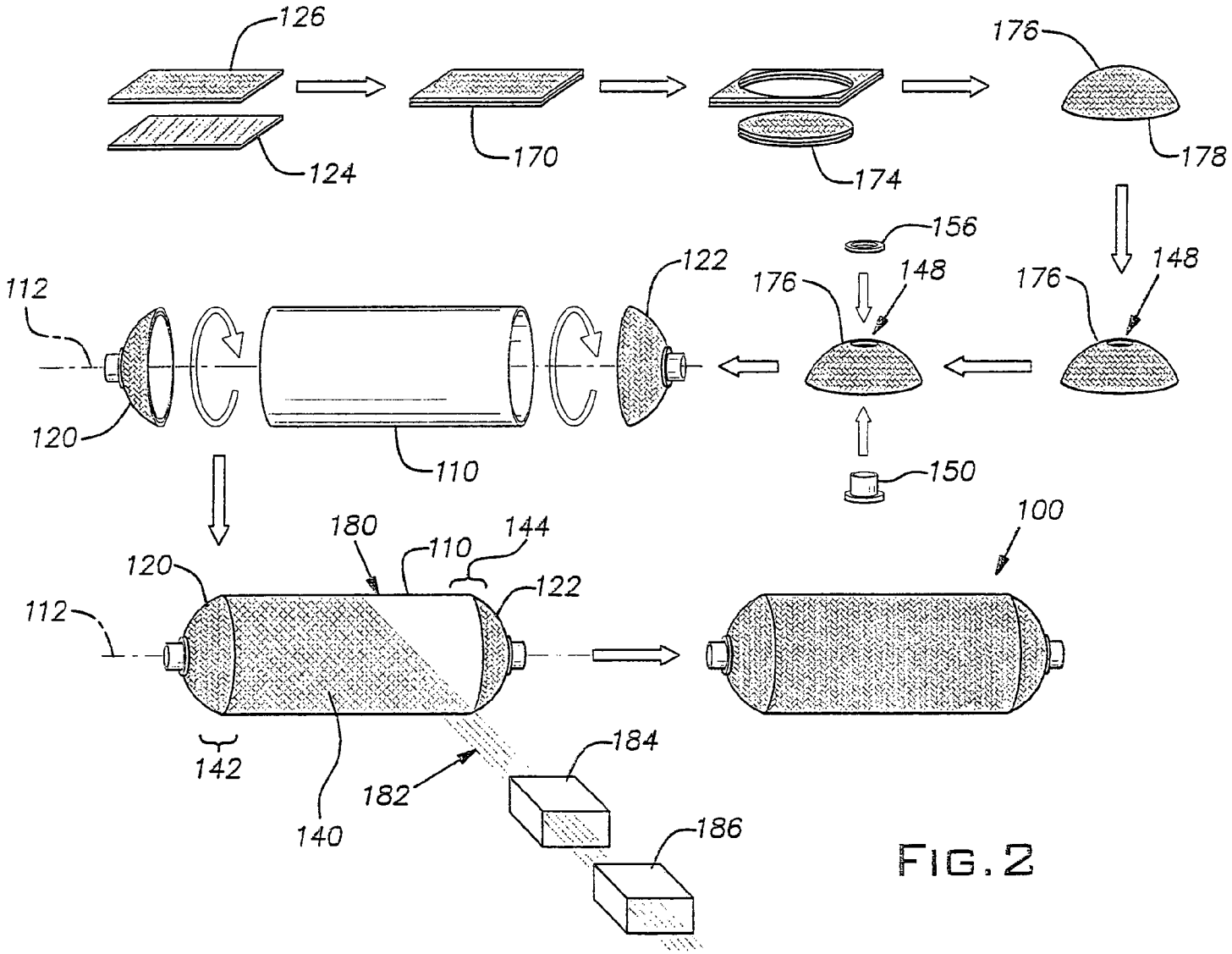
FIG. 2 schematically illustrates an assembly process of the vessel shown in FIG. 1.
Figure 4:
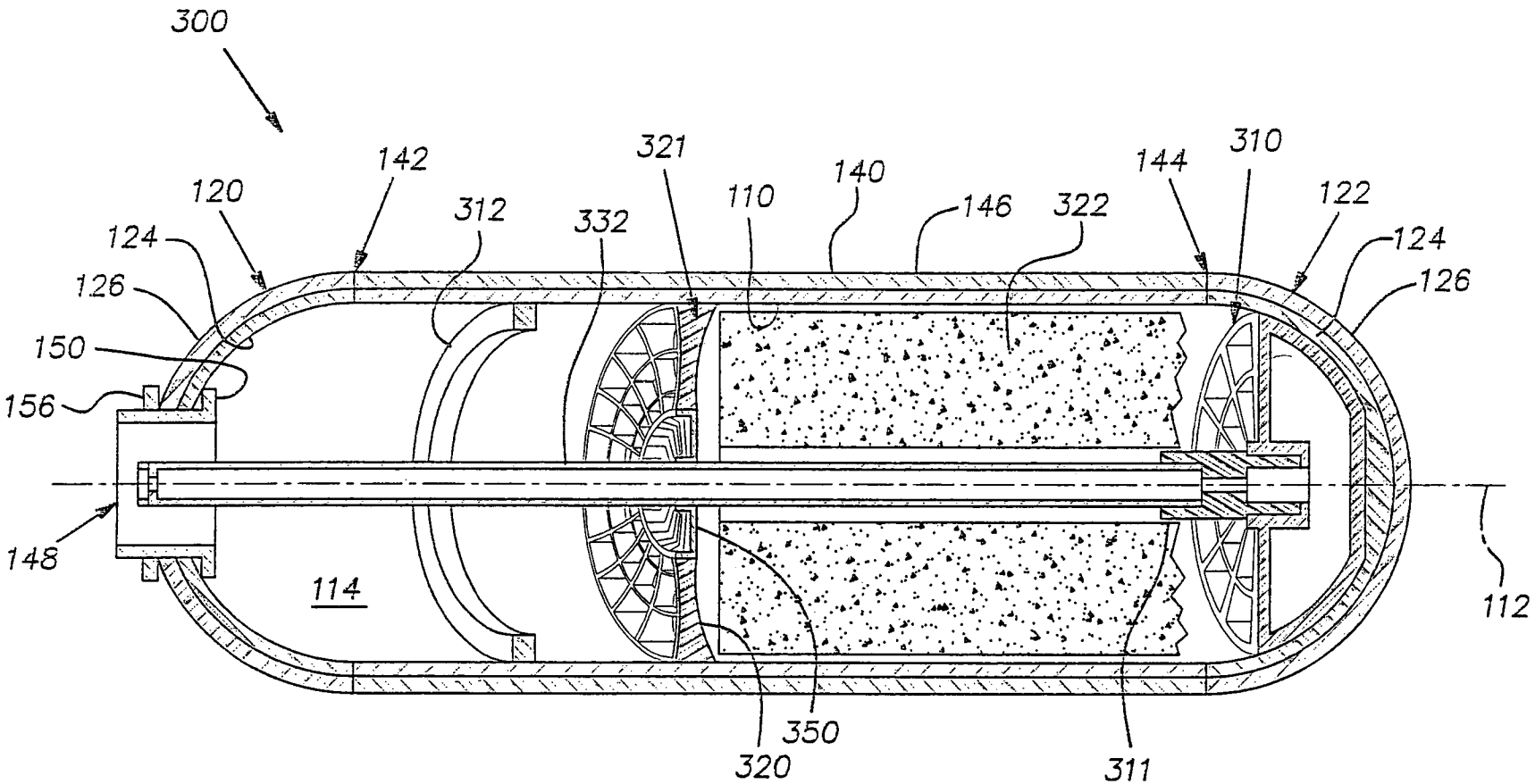
FIG. 4 is a cross-sectional perspective view of a composite pressure vessel used as a filter media receptacle according to the invention.

An overwrap layer 140 is wound onto the liner 110. The overwrap layer 140 is a continuous glass filament thermoplastic composite layer (i.e., commingled glass and thermoplastic fibers) that is heat sealed to the liner 110. These fibers are like the TWINTEX fibers that form the second layer 126, but are supplied in an endless or continuous format suitable for continuous filament winding. With reference to FIGS. 1, 2, and 4, the overwrap layer 140 is shown schematically. Preferably, portions of the overwrap layer 140 extend across the transition areas 142, 144 and, accordingly, overlie at least the free edges of the endcaps 120, 122. Accordingly, the depiction of the layers in FIG. 1 is schematic, and overwrap layer 140 may actually have an outer surface 146 that extends over the first and the second transition areas 142, 144.

The endcaps 120, 122 define apertures 148 that are centered on the axis 112. First and second compression fitting assemblies 150, 152 extend through the apertures 148, as illustrated. The fitting assemblies 150, 152 may be formed from metal, thermoplastic, or other suitable materials, and include locking collars 156, 158 that lock the respective fitting assemblies 150, 152 to the endcaps 120, 122. Other fittings and fitting installation techniques may be used without departing from the scope of the present invention. In alternative embodiments, the fitting assemblies 150, 152 are different from each other.

With reference to FIG. 2, a method of making and assembling the composite vessel 100 is shown. First, the endcaps 120, 122 are formed, whereby a heater (not shown) heats a commingled fabric 126 to consolidate it, thus forming the second layer 126. Suitable consolidation techniques to form the second layer 126 are known to those of ordinary skill in the art. More particularly, the heater heats the second layer 126 to a temperature sufficient to melt the thermoplastic fibers and thereby cause the melted thermoplastic to flow around and encapsulate the reinforcing fiber in the resultant thermoplastic matrix.

The second layer 126 overlays the first layer 124. The layers 124, 126 are consolidated with each other to form a laminated sheet 170. As described above, the layers 124, 126 are heated to a temperature sufficient to melt the thermoplastic of the layers 124, 126, to seal and consolidate the layers 124, 126 to each other and form the unitary or integral laminated sheet 170. It is preferable that the same thermoplastic (e.g., polypropylene) is used in each of the layers 124, 126 so that the melting points of the thermoplastics are the same. However, in alternative embodiments the thermoplastic in one of the layers may be selected so as to melt preferentially with respect to the thermoplastic of the other layer. In such an embodiment, a thermoplastic with a different melting point may be employed so as to facilitate preferential melting.

The sheet 170 is cut to a desired shape, for example a disk shape, to create a preform cutout 174. The preform cutout 174 is compression molded to form a dome 176. Those of ordinary skill in the art know suitable compression molding techniques. The dome 176 has a free circular edge 178. The free edge 178 defines an end of a cylindrical extended portion of the dome 176, and has about the same diameter as the liner 110. Alternatively, the dome diameter may be less than or greater than that of the liner 110 so that the resulting endcap 120, 122 and liner 110 nest or overlap at the edges (transition zones) during assembly.

A circular aperture 148 for the compression fitting assembly is cut into an end of the dome 176, and the compression fitting assembly 150 is installed on the dome 178. The compression fitting assembly 150 is positioned in the aperture 148 and locked into place with the fitting collar 156. The fitting assembly 150 and fitting collar 156 are heat sealed, or attached by other means, to the dome 176 to form the endcap 120. The process is repeated to form the second endcap 122.

As described above, the endcaps 120, 122 are secured to the liner 110 to form a vessel subassembly 180. In particular, the free edge 178 is contacted against the end of the liner 110 and secured to the liner 110. The process is repeated for the second endcap 122. The endcaps may be spin-welded, heat welded or laser welded to the liner 110, as desired, depending upon the size of the vessel and the disposition of the endcap free edges 178 relative to the liner. For example, if the endcaps abut the liner, spin welding may be most appropriate, whereas, if the endcaps and liner overlap, laser welding may be preferred.

Commingled, continuous glass and thermoplastic fibers 182 are heated and wrapped over the liner 110 and transition areas 142, 144 using a hot (melt) wind technique. The glass and thermoplastic fibers 182 are consolidated during the winding step to form the overwrap layer 140. The glass and thermoplastic fibers 182 are commercially available as TWINTEX continuous filaments from Saint-Gobain Vetrotex America Inc. (Valley Forge, Pa.), herein after referred to as commingled continuous fibers.

In the hot wind process, a heater 184 heats the commingled fibers 182 to a temperature sufficient to melt the thermoplastic fibers. The melted thermoplastic fibers coat the glass fibers and remain sticky at that temperature. Because the melted thermoplastic fibers of the commingled fibers 182 are sticky, they adhere to the vessel subassembly 180, and particularly to the liner 110, as they are wrapped about the vessel subassembly 180, preferably by rotating the liner while the fibers are moved axially and fed through the heater. Upon cooling, the coated glass fibers are consolidated with the thermoplastic and form the overwrap layer 140.

If a colored vessel is desired, a colorant is applied to the fibers 182 by a colorant bath 186. Suitable colorants are commercially available from, for example, Colormatrix Corp. (Cleveland, Ohio). Specifically, the fibers 182 are directed through the bath 186 where the liquid colorant wets out some of the fibers 182. A doctor blade (not shown) removes excess colorant from the fibers 182. The colorant carrying fibers travel to the heater 184. The heater 184 heats the fibers 182 to a temperature sufficient to melt the commingled thermoplastic fibers. The melted thermoplastic fibers retain the colorant so that the sticky, melted fibers adhere to the liner 110 to form the overwrap layer 140 in the desired color. Also if desired, colored endcaps 120, 122 can be produced by applying colorant to the second and/or first layers of the endcap, which are otherwise as described hereinbefore.

The vessel 100 can be used as a water tank to hold, for example, hot water or pressurized water. The woven commingled fabric in the endcaps 120, 122, as well as the continuous filament overwrap layer 140, provide a desired level of strength and stability to the vessel 100. Since the endcaps 120, 122 are inherently reinforced by the consolidated fabric of their outer layers 126, they do not need to be overwrapped with the overwrap layer 140. However, the overwrap layer may also be applied to the endcaps, if desired, as a helical-type wrap.

As an alternative to the hot wind technique described above, the vessel subassembly 180 is over-wrapped with commingled, continuous glass and thermoplastic fibers using a dry filament winding technique. The dry or unheated fibers are wrapped under tension. The glass and thermoplastic fibers that form the dry overwrap layer are like the fiber 182, that is, they are commingled continuous-filament fibers.

The dry-wrapped fibers must be subsequently consolidated with the vessel subassembly 180. To consolidate the fibers, a one-piece or a split-mold molding apparatus may be used. The molding apparatus preferably has an inner surface with a diameter that is slightly larger than the outer diameter of the dry, over-wrapped layer on the vessel subassembly 180. During consolidation, the first fitting assembly 150 is closed or blocked and the dry overwrapped vessel subassembly 180 is placed in the molding apparatus. Infrared heating elements or a radiant heating element heats the dry-wrap fiber layer to melt the thermoplastic, which in this embodiment is polyethylene, so that the commingled thermoplastic and glass fibers consolidate with the vessel subassembly 180. The mold is cooled and the resultant composite vessel is removed.

Figure 3:
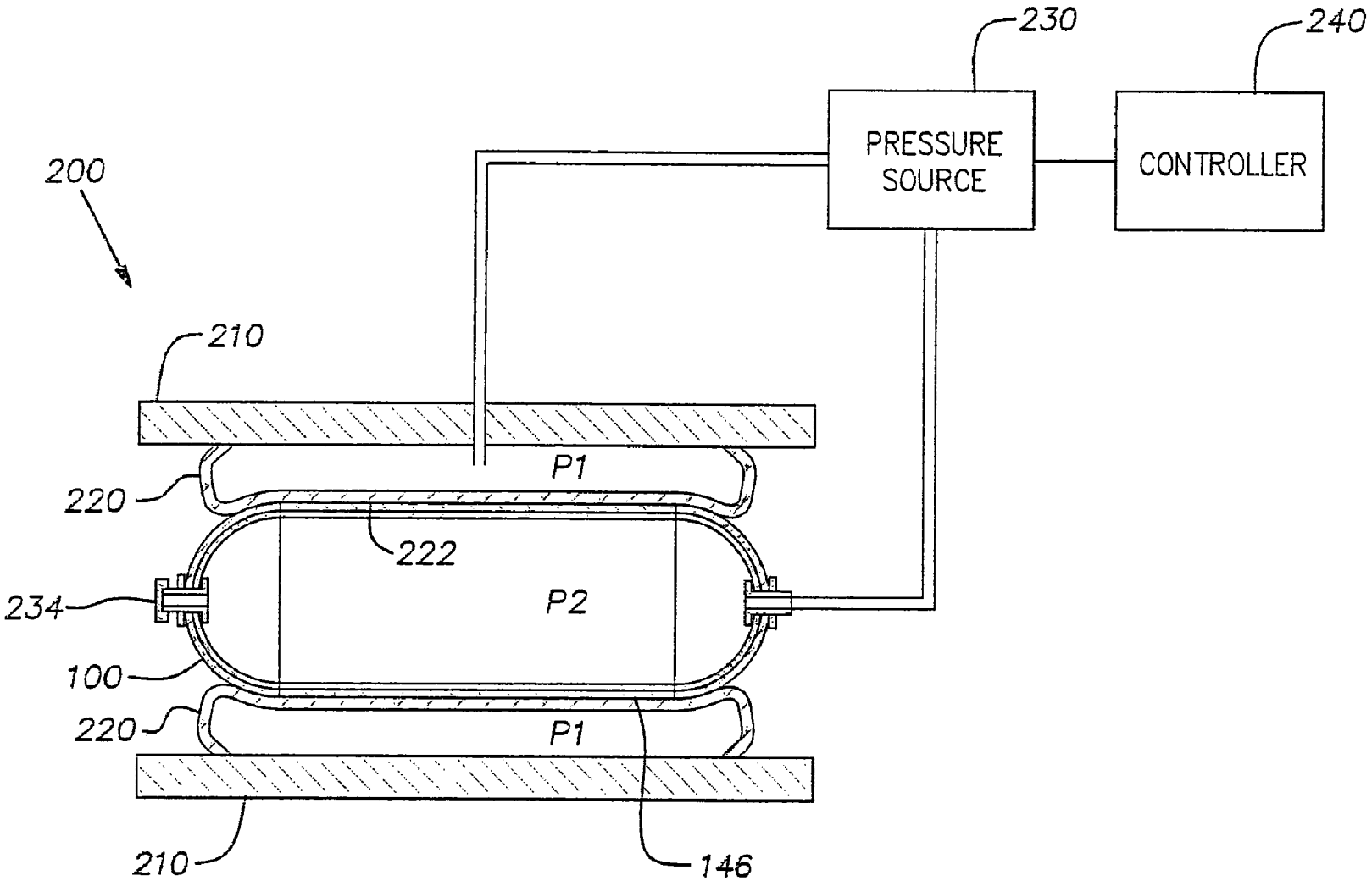
FIG. 3 is a cross-sectional schematic view of a composite pressure vessel finishing system according to the invention.

A texturing assembly 200 for modifying or forming a vessel surface texture is shown in FIG. 3. The texturing assembly 200 modifies and forms a surface texture on an outer surface of the composite pressure vessel 100, described above. The texturing assembly 200 includes a support base 210 that supports an inflatable and pressurizable elastomeric/flexible bladder 220. The bladder 220 has an inwardly facing surface 222 with a surface texture that can be completely flat and smooth, embossed, patterned or otherwise textured, as desired.

A pressure source 230 communicates with the bladder 220 and, optionally, with the second fitting assembly 152 of the vessel 100. The pressure source 230 is controlled by the controller 240 and supplies air, suction, and, optionally, cold water to the bladder 220. For example, the pressure source 230 can supply pressurized cold water having a pressure P1 to the bladder 220, and pressurized air having a pressure P2 to the vessel 100, or air to both. The pressure source 230 can also supply sub-atmospheric pressure or vacuum to the bladder, as described hereinafter.

A sealing plug 234 engages and seals the first fitting assembly 150. A controller 240 controls the pressure source 230, which includes a valve system (not shown). The controller 240 actuates the pressure source 230, including the valves, to control the pressures P1, P2 in the bladder 220 and the vessel 100, respectively. The controller 240 controls the pressure source 230 to evacuate the bladder 220, and to pressurize the bladder 220 and the vessel 100.

Prior to placement within the texturing assembly 200, the vessel 100 is heated by, for example, an infrared heater that softens the vessel outer surface, especially the outer surface 146 of the overwrap layer 140. The vessel 100 is inserted into the texturing assembly 200 so that the pre-heated outer surface 146 of the vessel 100 is adjacent to the inwardly facing surface 222 of the bladder 220. To facilitate insertion of the vessel 100 into the bladder 220, vacuum or sub-atmospheric pressure may be applied to the bladder to thereby suction the bladder against the support base 210 and increase the available space for the vessel 100.

The pressure source 230 is connected to the vessel 100 and the texturing assembly 200. When the vessel is disposed within the bladder 220, pressurized fluid is introduced into the bladder 220 and the bladder inflates and moves toward the vessel 100. Also, the vessel 100 may be pressurized with pressurized fluid, if desired, so as to provide support for the vessel and thereby reduce risk of the vessel collapsing. The bladder surface 222 engages the vessel surface 146 and, because the outer surface 146 of the vessel 100 is pre-heated and soft, the texture of the bladder surface is impressed into the vessel surface. Thus, the outer surface 146 of the vessel 100 becomes likewise textured.

Cold water or air may be introduced into the bladder 220 to cool the bladder 220 and, consequently, the outer surface 146 of the vessel 100 by contact. Cooling the outer surface 146 of the vessel 100 hardens the outer surface 146 of the vessel 100. The hardened outer surface 146 retains the texture imprinted by the inwardly facing surface 222 of the bladder 220. The cold water or air may be introduced into the bladder 220 to inflate the bladder, or may be circulated through the bladder 220 at a predetermined point following initial inflation and contact between the bladder and the vessel. Cooling the bladder helps to reduce cycle times in vessel texture processing.

The controller 240 controls the pressure source 230 to reduce the pressures P1, P2 in the bladder 220 and vessel 100 and, optionally, introduction and circulation of cooling fluid through the bladder, as discussed hereinbefore. Once the vessel 100 has cooled sufficiently to provide a stable surface texture, the vessel 100 is disconnected from the pressure source 230, the bladder 220 is deflated (i.e., by suctioning out the fluid contained therein), and the vessel is removed from the texturing assembly 200.

Figure 8:
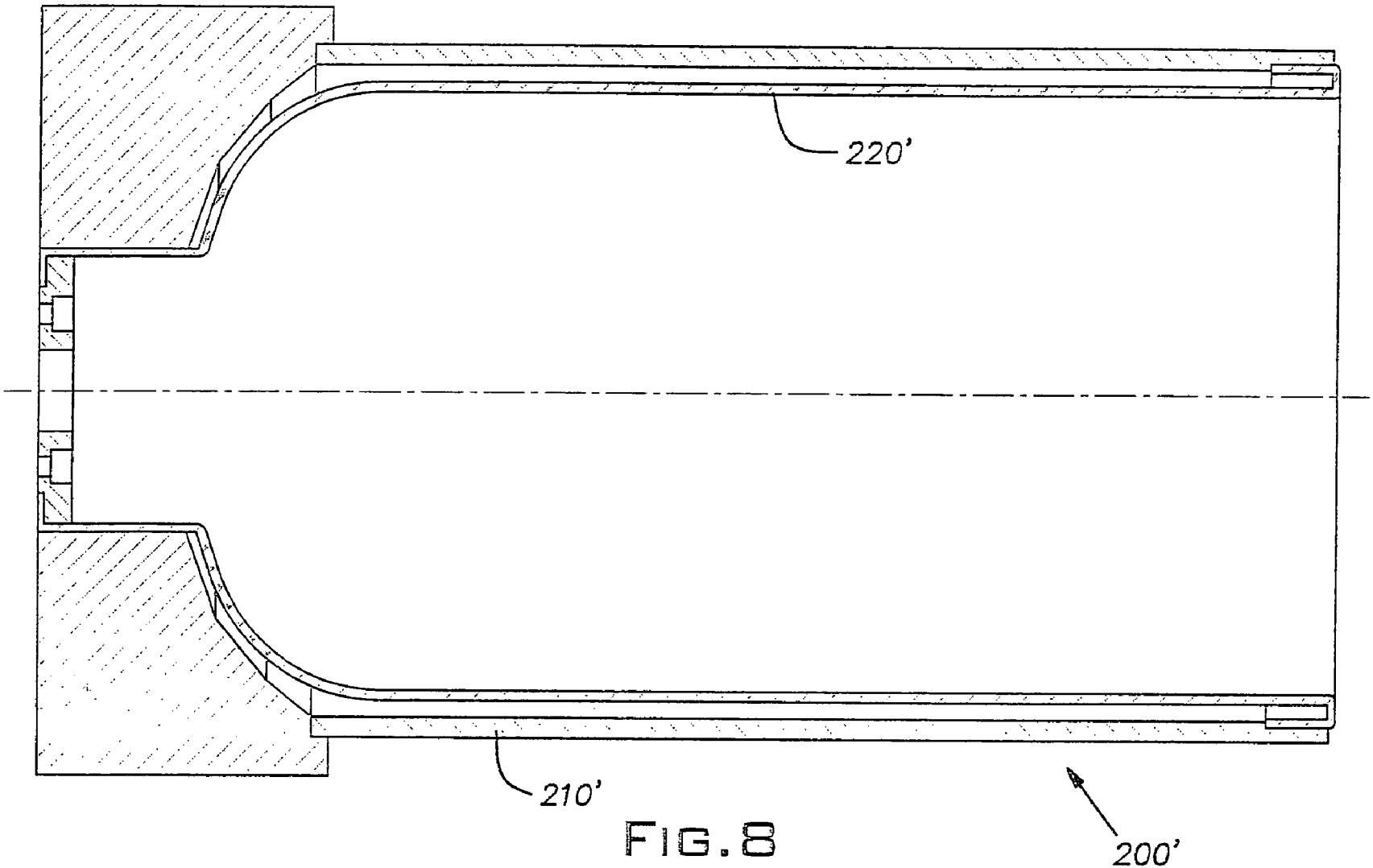

The texturing assembly 200 described hereinbefore and illustrated in FIG. 3 provides a desired surface texture to the sidewall of the vessel 100, but not to either endcap. An alternative texturing assembly illustrated in FIG. 8 is adapted to provide a desired surface texture to an endcap of the vessel. With reference to FIG. 8, an alternative texturing assembly 200' includes a support frame or housing 210' and an inflatable bladder 220'. As will be appreciated by reference to the drawing, the housing 210' surrounds the bladder and permits the bladder to generally define a receptacle for receipt of one end (i.e., endcap) and liner portion of a vessel 100. When the preheated vessel 100 is so inserted into the texturing assembly 200', pressurized fluid may be introduced into the bladder 220' such that the bladder moves against and modifies the outer surface of the vessel, including the endcap, the transition area associated with the endcap, and overwrap layer outer surface 146. The remaining processing (i.e., inflating, deflating, cooling) is generally identical to that discussed hereinbefore with regard to the texturing assembly of FIG. 3. However, using the alternative texturing assembly 200' permits a surface texture to be applied to the upper or first endcap as well as to the cylindrical sidewall.

A vessel 300 comprising a third embodiment of the invention is shown in FIG. 4. The vessel 300 includes many parts that are substantially the same as corresponding parts of the vessel 100; this is indicated by the use of the same reference numerals in FIGS. 1 and 4. The vessel 300 differs in that it includes a plurality of internal structures disposed within the cavity 114. The plurality of internal structures in the illustrated embodiment defines a water treatment assembly including a fluid diffuser 310, a reinforcing rib 312, a perforated separator 320, and filter media 322. The filter media 322 is, for example, activated carbon and is shown cut-away for clarity. Additional and optional filter media located opposite the separator 320 from the filter media 322 is not shown for clarity.

The ring-shaped separator 320, which is preferably formed from a thermoplastic material, defines a central aperture and a peripheral flange 321. Depending upon the size of the perforations or slotted openings formed in the separator 320, a fine mesh screen (not shown) may be incorporated into the separator 320 to prevent migration of filter media 322. The peripheral flange 321 is adapted to be secured to the liner inside surface, preferably by laser welding or equivalent attachment techniques, prior to attachment of the endcaps thereto.

The diffuser 310 is secured to the second endcap 122 at what may be considered to be a bottom of the vessel 300. The diffuser 310 may be secured to the endcap by conventional welding or thermoplastic joining techniques or, alternatively, by mechanical fasteners such as plastic rivets and/or plastic screws. The diffuser 310 receives water through a central inlet connector 311 and directs fluid upwardly and outwardly toward the filter media 322 that is disposed thereon. Accordingly, appropriate perforations or slotted openings are formed in an upper wall of the diffuser 310 through which water flows into the filter media 322.

The internal structures are secured to the liner 110 and the second endcap 122 prior to the securing of the endcaps 120, 122 to the liner 110. For example, the diffuser 310 is affixed to the second endcap 122 and the separator 320 is secured to the liner 110, as described hereinbefore. This prior placement allows larger structures to be placed into the vessel than would otherwise be possible. Once the diffuser 310 and separator 320 are secured to the second endcap and the liner, respectively, the endcaps 120, 122 are secured to the liner 110. Thereafter, the vessel may be further manufactured (i.e., overwrapped). Once the vessel structure is complete, the remaining portions of the water processing assembly are inserted into the vessel 300 via the opening in the first endcap 120.

An annular access plate 350 fits into the ring-shaped separator 320, preferably using a tab and slot arrangement wherein the access plate 350 is inserted into the separator 320, cooperating tabs and slots provided by the plate 350 and separator are aligned, and the access plate 350 is rotated to lock the tabs into the slots and, thus releasably attach the plate 350 to the separator. Naturally, the plate 350 may be releasably secured to the separator 320 by alternative means, such as a snap-fit arrangement or a friction or interference-type fit.

Using the cooperating tabs and slots, the access plate 350 is removed from the separator 320 by turning and lifting and attached to the separator 320 by turning and pushing. Because the access plate 350 is smaller than the aperture 148 and the hollow fitting assembly 150, the access plate 350 may be inserted into and removed from the vessel 300 through the hollow fitting assemble 150.

A water inlet tube 332 extends axially through the vessel, through a central opening in the access plate 350, and is inserted into the inlet connector 311 of the diffuser 310. Preferably, a frictional or interference-type connection is provided between the water inlet tube 332 and the diffuser inlet connector 311. More positive, but releasable, connections between the inlet tube 332 and the inlet connector 311 are also contemplated. Further, a non-removable or integral connection between the water inlet tube and the diffuser may also be used with similar results.

In order to charge the vessel with filter media 322, the access plate 350 is removed from the vessel 300, as described hereinbefore, the open or distal end of the water inlet tube 332 is plugged or capped, and a hollow fill tube (not shown) is inserted into the vessel concentric with the water inlet tube 332. The hollow fill tube extends into the vessel and abuts the separator 320 adjacent to and in alignment with the central aperture formed therein, which previously was covered by the access plate 350. Thereafter, filter media 322 may be is inserted through the fill tube in the annular space defined between the fill tube and the water inlet tube 332. The filter media falls through the fill tube and through the annular aperture in the separator 320 and falls down onto the diffuser 310, filing the space between the diffuser 310 and the separator 320. When a sufficient quantity of filter media 322 has been added to the vessel 300, the fill tube is removed, and the access plate 350 is reinstalled on the separator.

Subsequently, an optional second media material (not shown) can be filled into a remaining, unfilled area of the cavity 114 above the separator 320. The separator 320 maintains the filter media separate from each other but allows fluid, for example water, to flow freely from the first area into the remaining area.

If the filter media is spent, and needs to be replaced, the water inlet tube 332 and the access plate 350 can both be removed from the vessel 300. A suction tube, similar to the fill tube, can vacuum the filter media 322 from the vessel 300. Once emptied of the filter media 322, the water inlet tube 332 can be reinserted and new filter media can be charged into the vessel 300 in the manner described hereinabove.

During operation, water flows through the water inlet tube 332 to the diffuser 310. The water flows from the diffuser 310 upwardly through the filter media 322. The water passes through the filter media 322 and further through the separator 320. If optional second media is present, the fluid flows through the second media and to the fitting assembly 150. The fluid exits the vessel 300 through the fitting assembly 150. The rib 312, which is optional, strengthens and stiffens the vessel 300.

Figure 5:
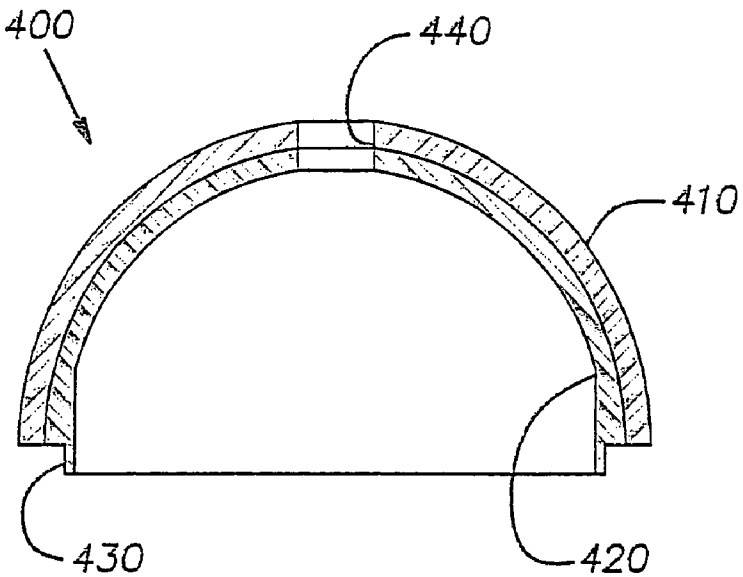
FIG. 5 is a cross-sectional view of an endcap according to the invention.

An alternative endcap 400 is shown in FIG. 5. The endcap 400 is a dome-shaped multi-layer article like the endcap 120. The endcap 400 includes a composite preform 410, which is a fiberglass reinforced thermoplastic composite of a predetermined shape.

A liner layer 420, for example a polypropylene layer, overlays an inside surface of the preform 410. The liner layer 420 extends beyond the free ends of the preform 410 to form a lip 430. The lip 430 is configured to cooperate with a cylindrical liner (described hereinbefore) to provide support for a seal between the structure 430 and the liner. For example, when the liner and the structure 430 are in cooperative engagement, a laser-sealing device can project energy through a portion of the liner to seal the liner to structure 430. Laser sealing is a process known to one of ordinary skill in the art. The thermoplastic of the preform 410 is compatible with the thermoplastic layer 420 and, preferably, they are formed from the same thermoplastic material.

In alternative embodiments, a dome-shaped composite layer is preformed and a thermoplastic layer is either overmolded to the outside of the dome or to both the inside and outside of the dome. This second method sandwiches the composite layer between two layers of thermoplastic. Free ends of the dome have a thermoplastic lip to facilitate attachment of the endcap to the cylindrical liner.

During production of the endcap 400, the preform 410 is consolidated prior to loading it into an injection molding apparatus (not shown). Thus, the mold apparatus receives the consolidated preform 410. Subsequently, the mold apparatus injects the hot, fluid thermoplastic liner layer 420. This process is sometimes referred to as over molding or insert molding.

The layer 420 consolidates with the preform 410. The consolidated layer 420 and the preform 410 cool to form the endcap 400. The endcap 400 is removed from the open mold apparatus. Additionally, the injection molding process can form the liner layer 420 so as to define an aperture 440 that also extends through the preform 410.

The endcap 400 is customizable in that the layer 420 need not be homogeneous. That is, some portions of the layer 420 may have reinforcing glass filler or fiber. This additional glass content in predetermined portions of the layer 420 adds additional strength and reinforcement at potential stress points. The differing strength characteristics of the endcap 400 compared to the endcap 120 can offer a desirable level of customizability for endcap manufacture and use.

Figure 6:
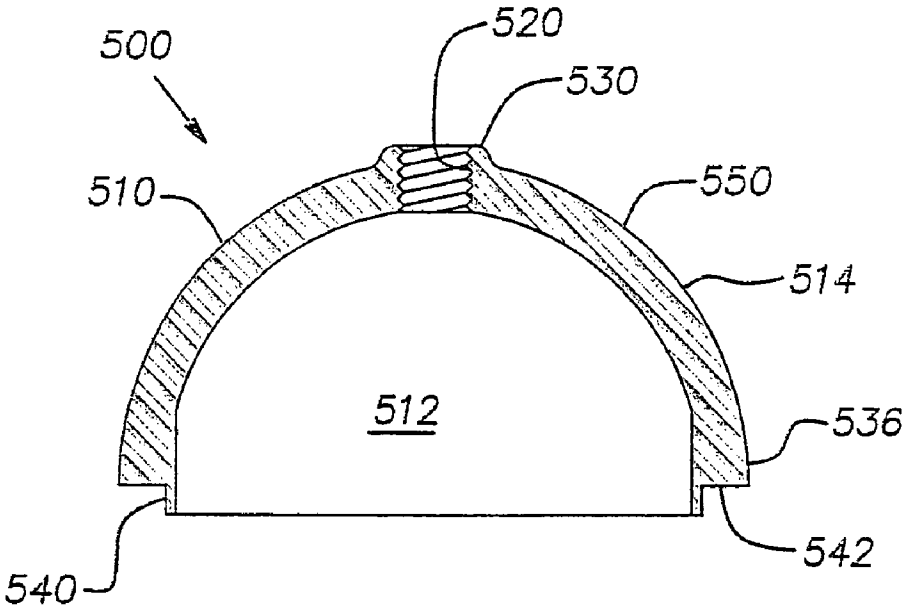
FIG. 6 is a cross-sectional view of an alternative endcap according to the invention.

A further alternative endcap 500 is shown in FIG. 6. The endcap 500 is a compression molded dome-shaped structure configured to fit to an end of the cylindrical liner 110. The endcap 500 is comprised of chopped TWINTEX commingled glass and thermoplastic fibers like the fibers 182 and has a body 510 with an inner surface 512 and an outer surface 514. The body 510 defines an aperture 520. The aperture 520 can be threaded, if desired, during the compression-molding step using a correspondingly threaded insert, which can be subsequently removed from the aperture 520 after molding. In alternative embodiments, the aperture 520 can be flared, frusto-conical, or otherwise shaped as desired.

The body 510 has an annular raised reinforcement portion 530 centered on the aperture 520. The portion 530 provides structural reinforcement to the body 510 at the aperture 520. A free end 536 of the body 510 is spaced from the aperture 520. The outer surface 514 defines a lip 540 and an abutment structure 542 at the free end 536. Disposed between the reinforcement portion 530 and the free end 536 is a shoulder portion 550. The shoulder portion 550 has a both a thickness and an arc in ranges that can be varied to result in a vessel having a predetermined strength.

During manufacture of the endcap 500, the fibers are chopped into lengths in a range of from about 1.25 cm (0.5 inch) to about 7.5 cm (3 inches). In this embodiment, the lengths are about 2.5 cm (1 inch). If desired, the short, chopped commingled fibers are mixed with virgin thermoplastic to adjust the glass to fiber ratio. Also if desired, an additive, for example a colorant, can be added to the mixture.

The chopped fibers are placed in a compression mold. A threaded disposable insert, if one is desired, may also be placed in the mold. The mold heats the chopped fibers to a temperature sufficient to melt the thermoplastic fibers. Once the sufficient temperature is obtained, the chopped fibers are compression-molded into a dome shape. The mold cools to a temperature sufficient to harden the fibers. The part is removed from the open mold. If an insert was used to shape the aperture 520, the insert is removed.

Figure 7:
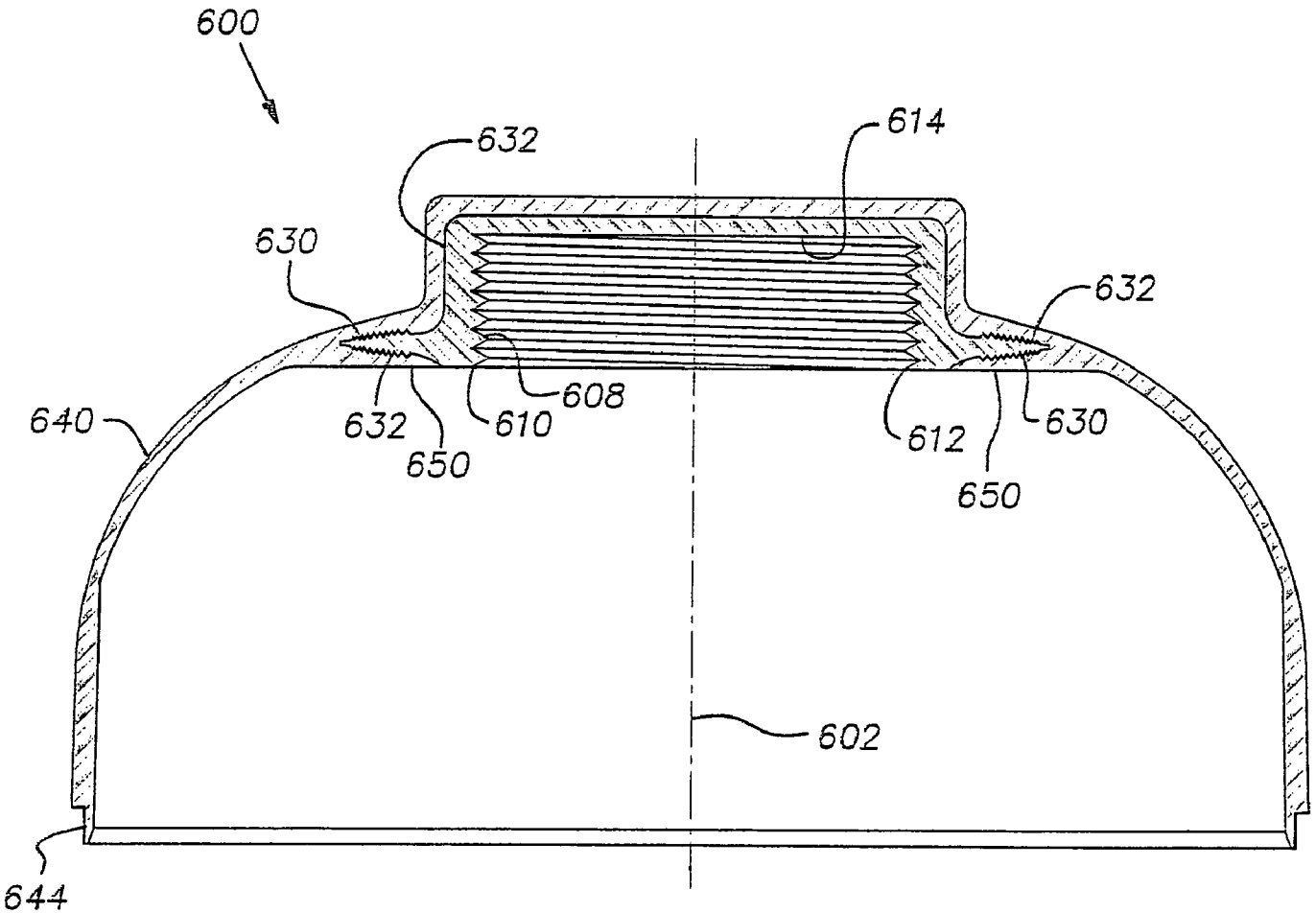
FIG. 7 is a cross-sectional view of another alternative endcap according to the invention; and, FIG. 8 is a cross-sectional view of an alternative texturing assembly.

With reference to FIG. 7, a further alternative endcap 600 is shown. The endcap 600 is an injection molded dome-shaped structure configured to fit to an end of the cylindrical liner 110. The endcap 600 defines an axis 602, and has an insert 610 centered on the axis 602. The insert 610 has a threaded inner surface 608 that defines an open end 612 and a closed end 614.

The insert includes a radially extending flange 630. The flange 630 includes ridges 632 protruding from the flange outer surface to facilitated bonding of the insert to surrounding material during manufacture of the endcap.

The endcap 600 has a dome body 640 with a lip 644 at a free end. The dome body 640 overlays the outer surface 632 of the insert 610. In addition, a portion 650 of the dome body 640 overlays the entire outer surface of the flange 630 so as to sandwich or encapsulate the flange 630 inside of the dome body 640.

During production, the insert 610 is positioned in a molding apparatus. Hot thermoplastic material is injected into the mold to bond with the insert 610. The heat melts the ridges 634 of the flange 630 and the injected thermoplastic bonds with the melted plastic of the ridges 634. The mold is cooled and the endcap 600 is removed from the mold.

After the endcap 600 is produced, a machining step cuts away the closed end 614 of the insert 610. Cutting the insert 610 and the dome body 640 in this way opens the insert 610 to create a threaded aperture through the insert 610 and the dome body 640.

The lip 644 of the endcap 600 is attached to the cylindrical liner 110. The endcap 600 and the liner are helically overwrapped with TWINTEX commingled fibers. The winding is performed in a single step. That is, the helical winding overwraps the sides and the endcaps at each of the liner ends. Alternatively, the insert may be advantageously incorporated into any of the other endcaps disclosed hereinbefore.

In other alternative embodiments in accordance with the invention, a system for forming a surface texture on an outer surface of a composite vessel has a bladder with a design logo embossed on it. Accordingly, when a melted outer surface of a composite vessel is contacted against the embossed inwardly facing surface of the bladder, the outer surface of the vessel assumes the imprint of the texture or embossment. Alternatively, an in-mold label is bonded to a melted outer surface of the composite vessel. Suitable in-mold labels are commercially available from, for example, Fusion Graphics, Inc. (Centerville, OHIO) and Owens-Illinois, Inc. (Toledo, OHIO). During operation, the in-mold label is placed between the outer surface of the composite vessel and the inwardly facing surface of the bladder. The surfaces are moved toward each other such that the in-mold label is contacted against the melted and sticky outer surface of the composite vessel. The in-mold label bonds to the outer surface of the composite vessel upon cooling.

In yet other alternative embodiments, a release coating is applied to a bladder before the bladder is contacted against a melted outer surface of a vessel. The release coating facilitates separation of the vessel from the bladder after the surfaces of each are contacted against one another.

The embodiments described herein are examples of structures, systems and methods having elements corresponding to the elements of the invention recited in the claims. This written description may enable those skilled in the art to make and use embodiments having alternative elements that likewise correspond to the elements of the invention recited in the claims. The intended scope of the invention thus includes other structures, systems and methods that do not differ from the literal language of the claims, and further includes other structures, systems and methods with insubstantial differences from the literal language of the claims.

What is claimed is:

1. A method for making a water treatment vessel, comprising the steps of:

(a) providing a thermoplastic cylindrical liner and first and second thermoplastic endcaps;

(b) bonding a diffuser to the second end cap, said diffuser including a fluid inlet connector;

(c) bonding a separator to an interior surface of said cylindrical liner;

(d) bonding the first endcap to a first end of said cylindrical liner and bonding the second endcap to a second end of said cylindrical liner to define a thermoplastic vessel subassembly;

(e) wrapping the vessel subassembly with an overwrap layer so as to define a reinforced pressure vessel; and, (f) inserting a water inlet tube through an opening in the first endcap and an opening in said separator, and connecting said water inlet tube to the fluid inlet connector of said diffuser.

2. The method according to claim 1, wherein said separator divides the interior of the vessel into a first compartment, extending from the first endcap to the separator, and a second compartment, extending from the diffuser to the separator, and, following step (f), comprising the further steps of:

extending a fill tube around the water inlet tube from an area outside the vessel to the second compartment; and, directing a filter media through the fill tube and outside of the water inlet tube into the second compartment, so as to fill said second compartment with filter media.

3. The method according to claim 1, wherein said separator includes a peripheral flange, which is bonded to said cylindrical liner, and a central access plate, said access plate being removably secured to said flange and defining the opening in the separator, and wherein said inlet tube extends through said access plate opening.

4. The method according to claim 3, wherein said separator divides the interior of the vessel into a first compartment, extending from the first endcap to the separator, and a second compartment, extending from the diffuser to the separator, and, comprising the further steps of:

removing said access plate;

extending a fill tube around the water inlet tube from an area outside the vessel to the separator;

directing a filter media through the fill tube and outside of the inlet tube into the second compartment, so as to fill said second compartment with filter media; and, replacing the access plate so as to retain said filter media in said second compartment.

5. The method of claim 4, comprising the further step of:

filling said first compartment with a further filter media.

6. The method according to claim 1, wherein in step (e), said overwrap layer is a continuous glass filament and thermoplastic composite layer.

7. The method according to claim 6, wherein step (e) further comprises heating and molding said overwrap layer so as to provide a predetermined outer surface texture to said overwrap layer.

8. The method according to claim 1, wherein steps (a)-(f) are performed sequentially.

9. The method according to claim 8, wherein said separator includes a peripheral flange, which is bonded to said cylindrical liner, and a central access plate, said access plate being removably secured to said flange and defining the opening in the separator, and wherein said inlet tube extends through said access plate opening.

10. The method according to claim 9, wherein said separator divides the interior of the vessel into a first compartment, extending from the first endcap to the separator, and a second compartment, extending from the diffuser to the separator, and, comprising the further steps of:

removing said access plate;

extending a fill tube around the water inlet tube from an area outside the vessel to the separator;

directing a filter media through the fill tube and outside of the inlet tube into the second compartment, so as to fill said second compartment with filter media; and, replacing the access plate so as to retain said filter media in said second compartment.

11. The method of claim 10, comprising the further step of:

filling said first compartment with a further filter media.

* * * * *